US007579992B2

(12) United States Patent
Ryou et al.

(10) Patent No.: US 7,579,992 B2
(45) Date of Patent: Aug. 25, 2009

(54) MULTI-BAND BUILT-IN ANTENNA FOR INDEPENDENTLY ADJUSTING RESONANT FREQUENCIES AND METHOD FOR ADJUSTING RESONANT FREQUENCIES

(75) Inventors: Byung-Hoon Ryou, Seoul (KR); Won-Mo Sung, Gyeonggi-do (KR); Jeong-Pyo Kim, Seoul (KR)

(73) Assignee: E.M.W. Antenna Co., Ltd., Seoul (KR)

( * ) Notice: Subject to any disclaimer, the term of this patent is extended or adjusted under 35 U.S.C. 154(b) by 332 days.

(21) Appl. No.: 11/570,769

(22) PCT Filed: Jun. 23, 2005

(86) PCT No.: PCT/KR2005/001947

§ 371 (c)(1),
(2), (4) Date: Dec. 16, 2006

(87) PCT Pub. No.: WO2006/001638

PCT Pub. Date: Jan. 5, 2006

(65) Prior Publication Data

US 2007/0236391 A1 Oct. 11, 2007

(30) Foreign Application Priority Data

Jun. 26, 2004 (KR) ..... 10-2004-0048671

(51) Int. Cl.
*H01Q 1/24* (2006.01)

(52) U.S. Cl. ..... 343/702; 343/700 MS

(58) Field of Classification Search ..... 343/700 MS, 343/702, 846

See application file for complete search history.

(56) References Cited

U.S. PATENT DOCUMENTS

| | | | | |
|---|---|---|---|---|
| 6,008,764 | A | 12/1999 | Ollikainen et al. | |
| 6,114,996 | A | 9/2000 | Nghiem | |
| 6,963,310 | B2 * | 11/2005 | Horita et al. | 343/702 |
| 7,242,355 | B2 * | 7/2007 | Vance | 343/702 |
| 2004/0130493 | A1 * | 7/2004 | Horita et al. | 343/702 |
| 2007/0268190 | A1 * | 11/2007 | Huynh | 343/702 |

FOREIGN PATENT DOCUMENTS

WO 02/35652 12/2006

* cited by examiner

*Primary Examiner*—HoangAnh T Le
(74) *Attorney, Agent, or Firm*—patenttm.us

(57) ABSTRACT

The invention relates to built-in antenna. Specifically, a multi-band built-in antenna having plurality of resonant frequencies and a method for adjusting resonant frequencies are provided, wherein resonant frequencies are able to be adjusted independently without affecting one another, for each resonant frequencies are adjusted separately through separate radiating elements.

11 Claims, 6 Drawing Sheets

[Fig. 1]
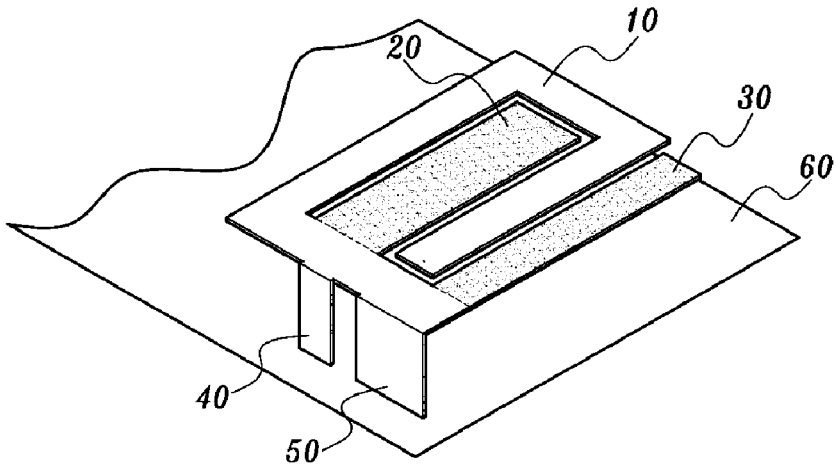
PRIOR ART
[Fig. 2]
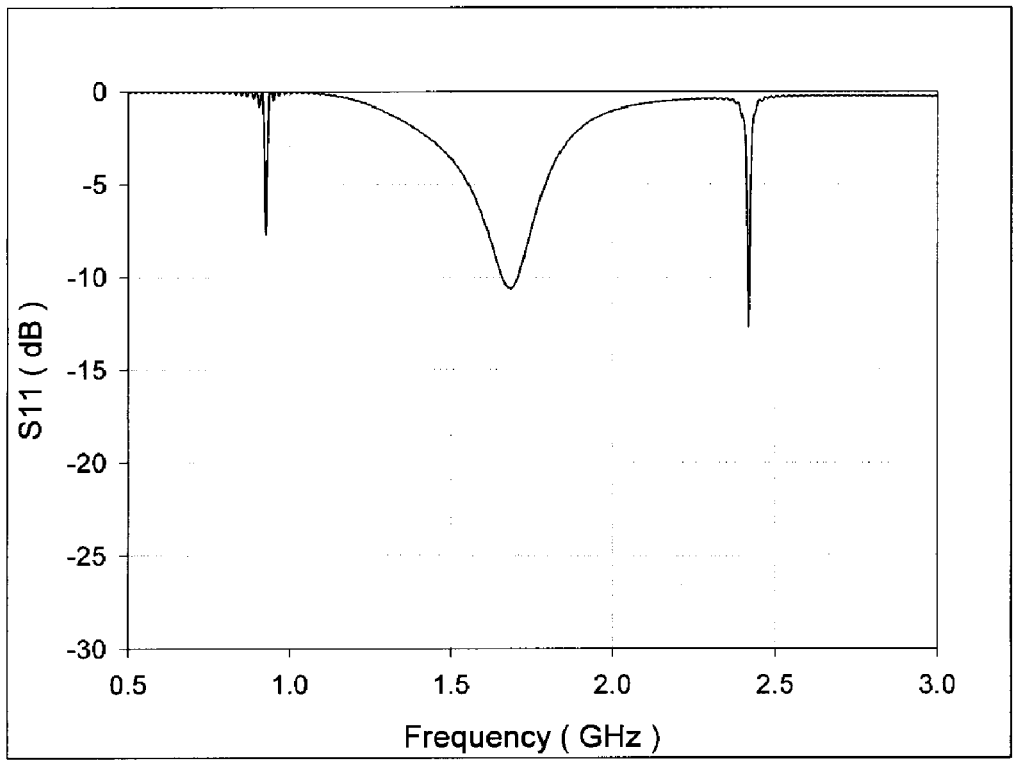
PRIOR ART

[Fig. 3]
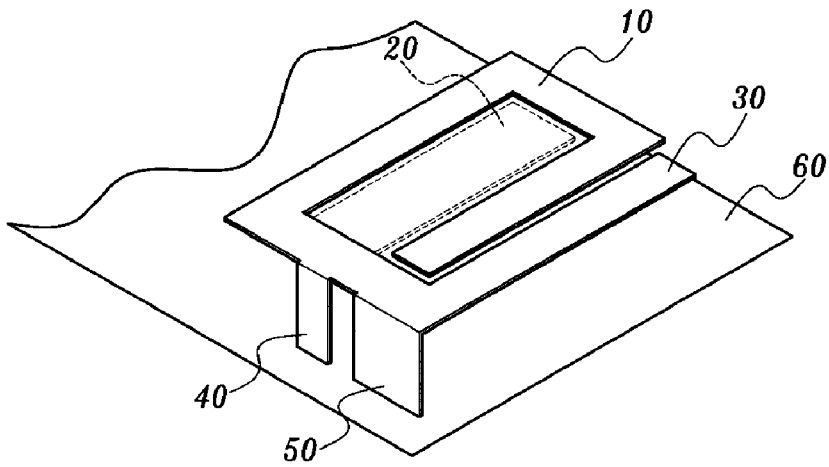
PRIOR ART
[Fig. 4]
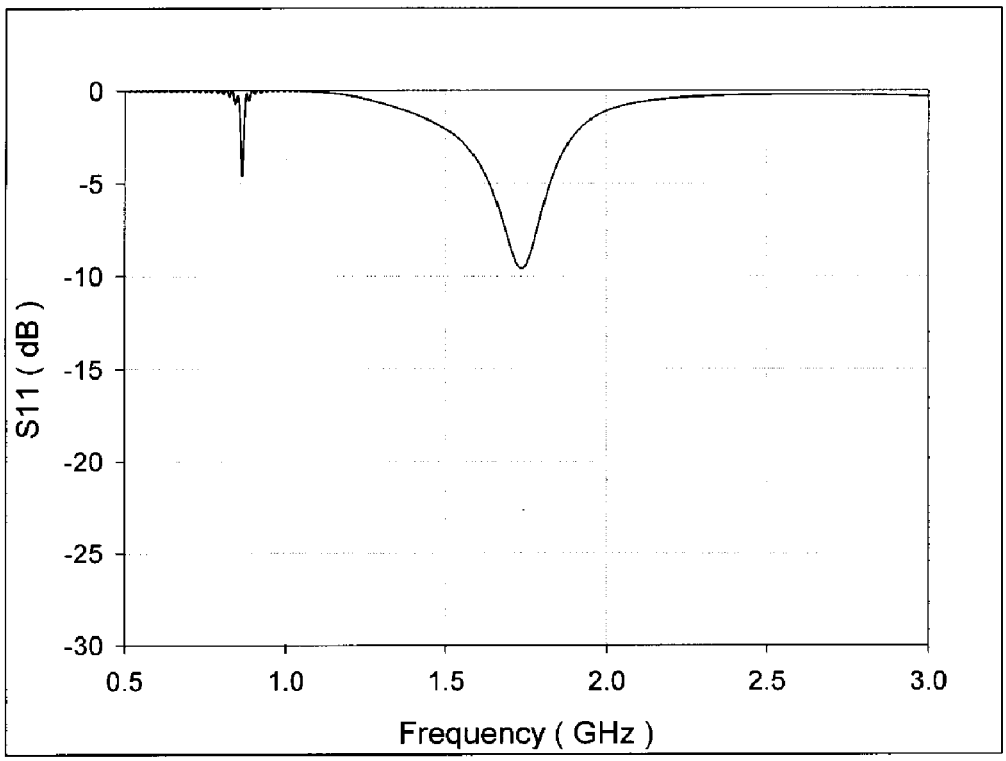
PRIOR ART

[Fig. 5]
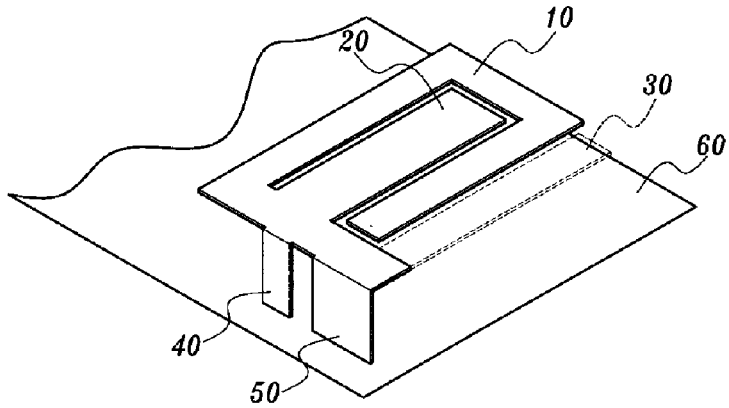
PRIOR ART
[Fig. 6]
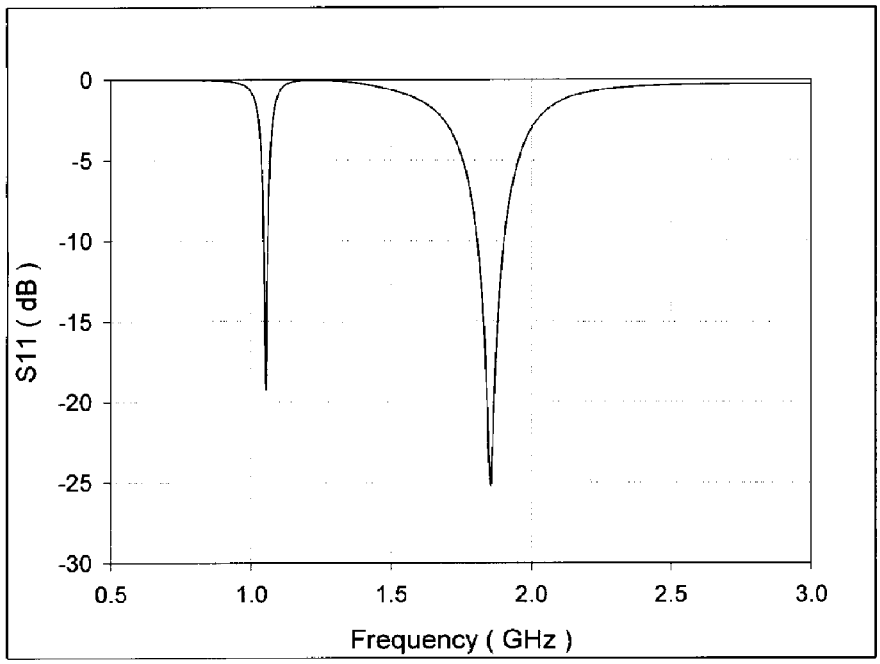
PRIOR ART
[Fig. 7]
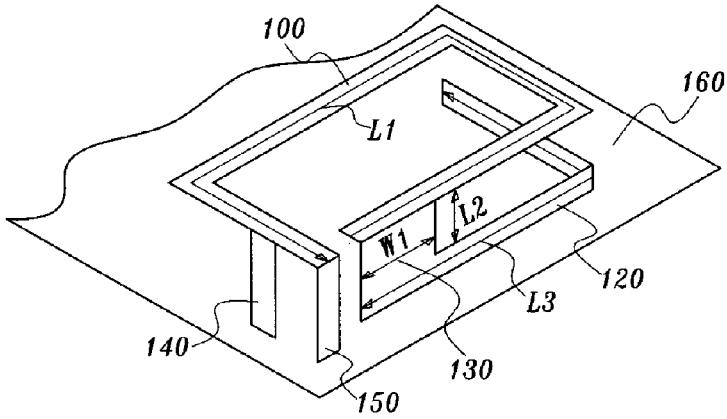

[Fig. 8]
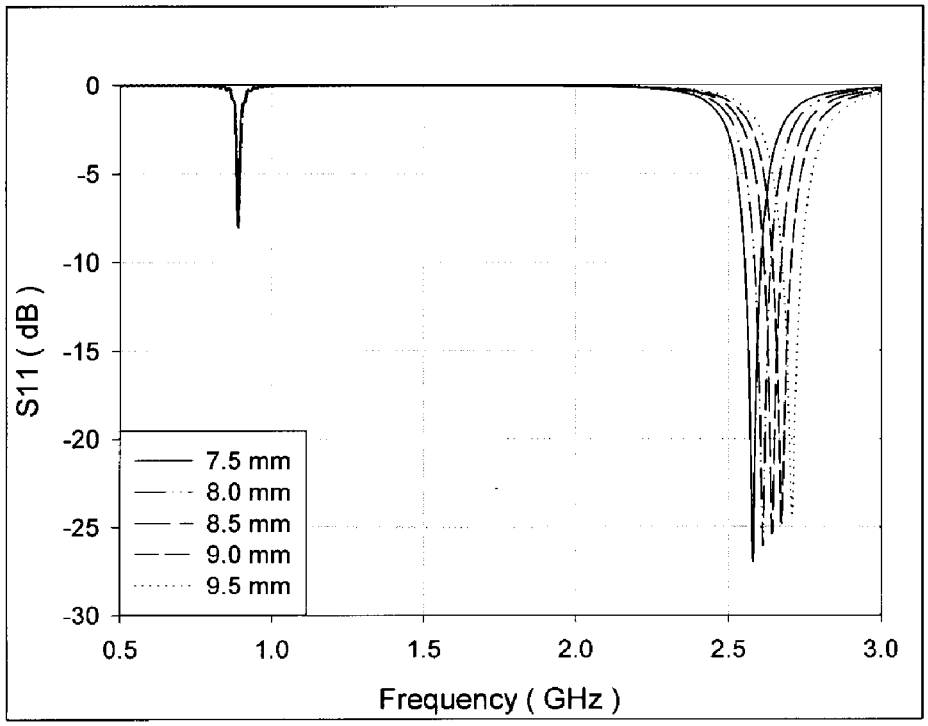
[Fig. 9]
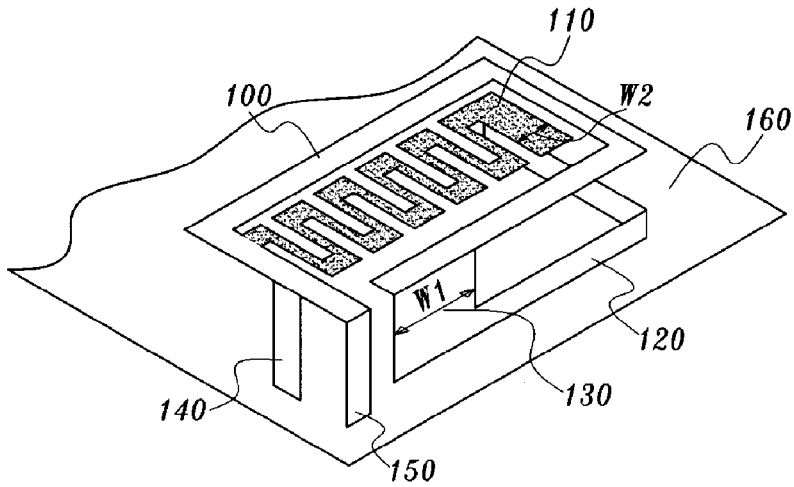

[Fig. 10]
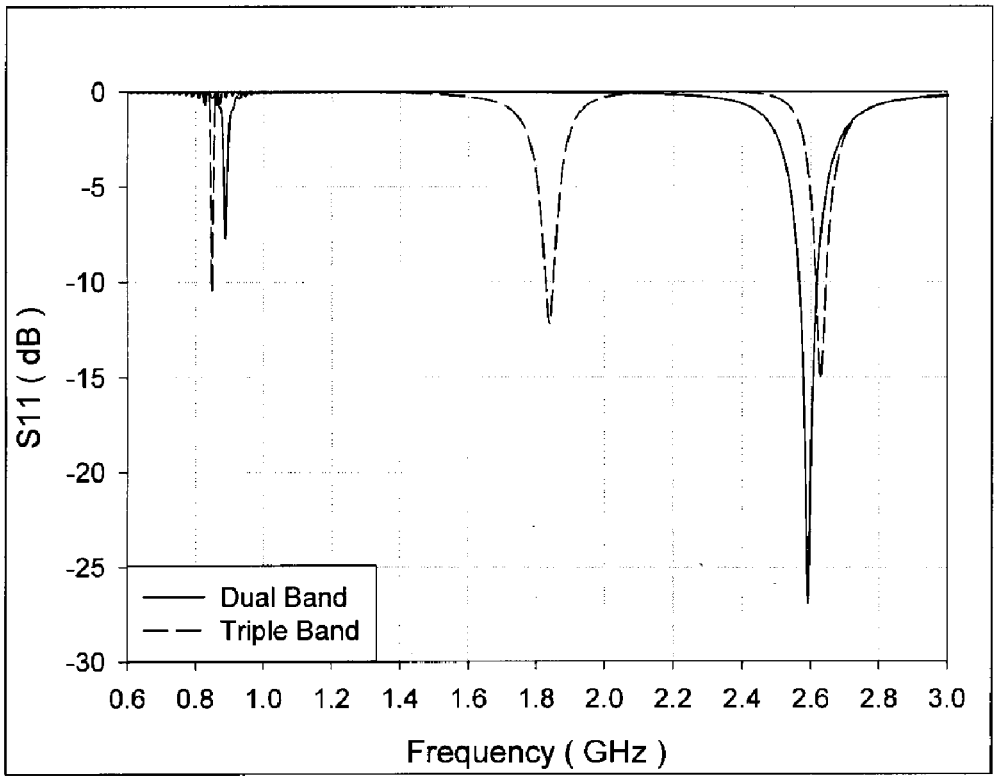
[Fig. 11]
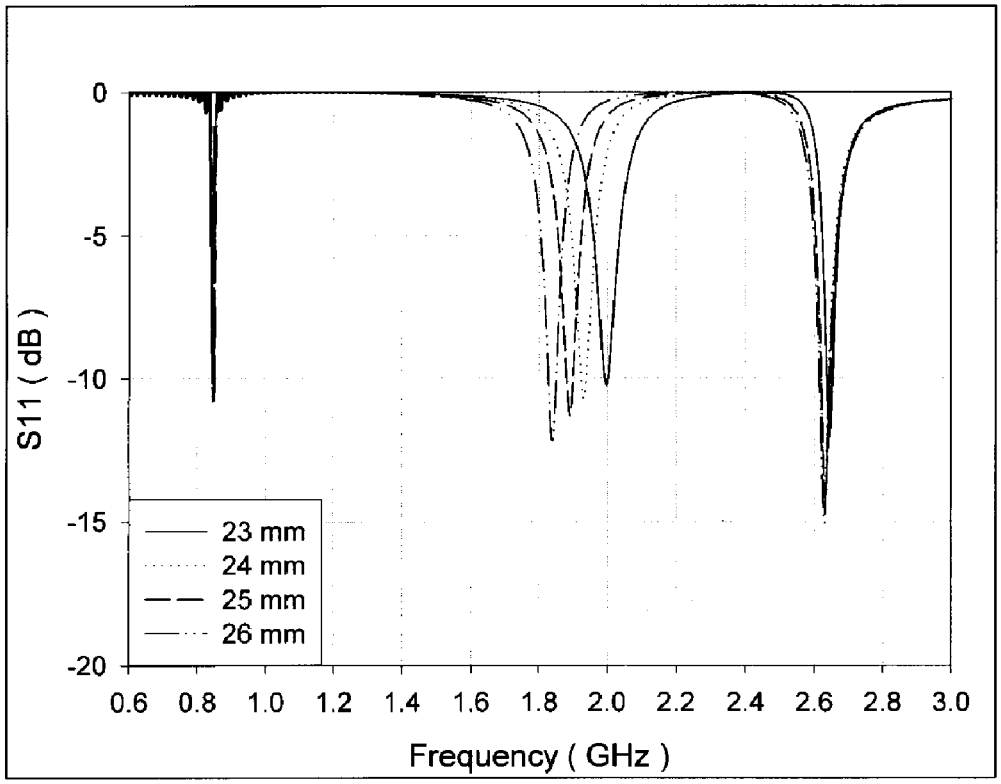

[Fig. 12]
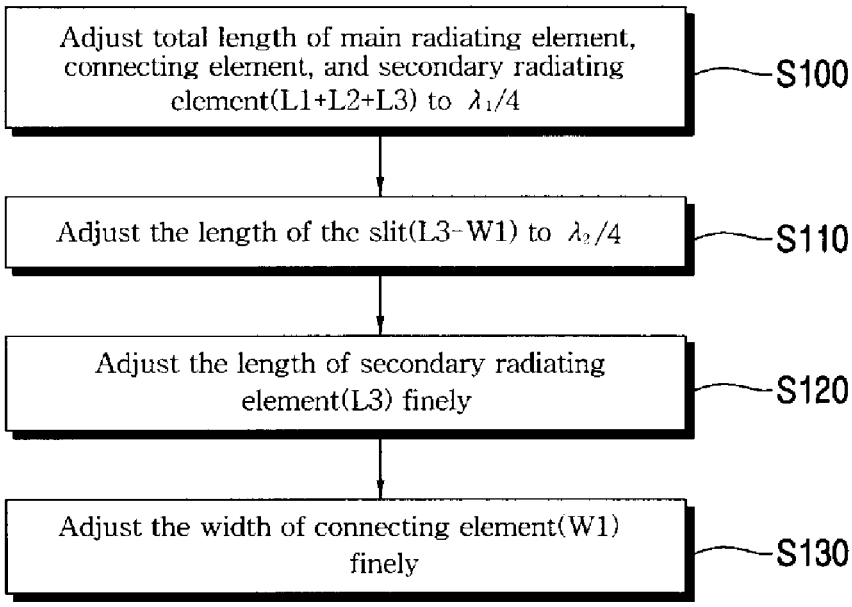
[Fig. 13]
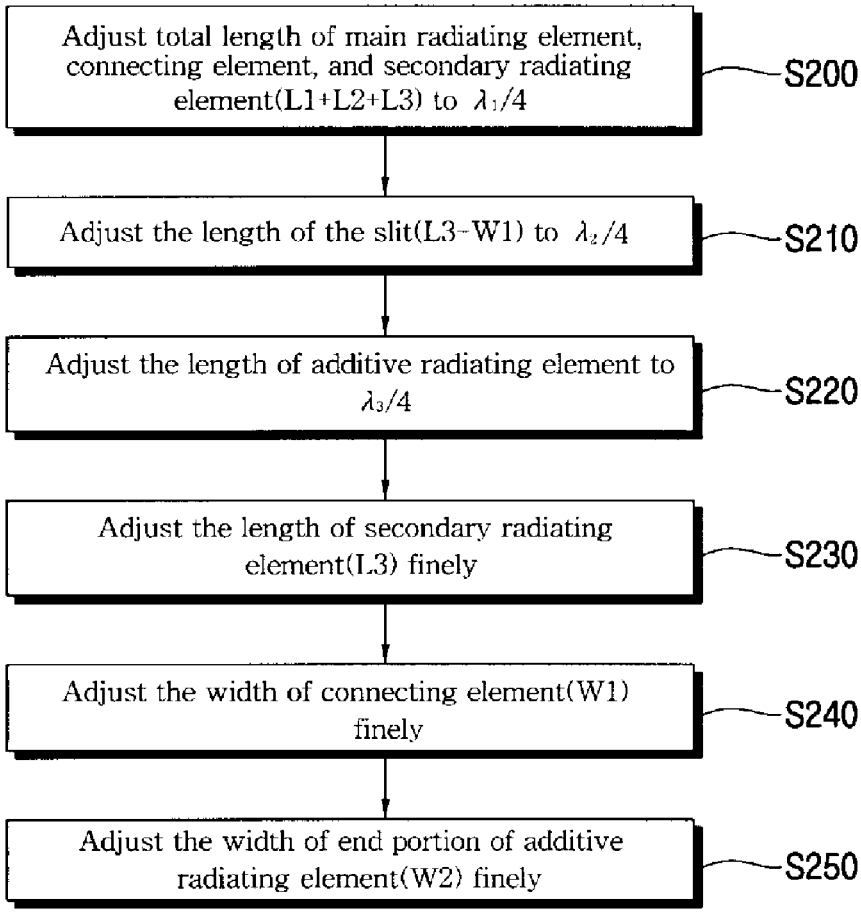

MULTI-BAND BUILT-IN ANTENNA FOR INDEPENDENTLY ADJUSTING RESONANT FREQUENCIES AND METHOD FOR ADJUSTING RESONANT FREQUENCIES

TECHNICAL FIELD

The invention relates to built-in antenna. Specifically, a multi-band built-in antenna having plurality of resonant frequencies and a method for adjusting resonant frequencies are provided, wherein resonant frequencies are able to be adjusted independently without affecting one another, for each resonant frequencies are adjusted separately through separate radiating elements.

BACKGROUND ART

Antennas are conductors placed in space to radiate radio waves or induce electromagnetic force effectively in the space for communication, or devices for receiving and transmitting electromagnetic waves.

Antennas have common basic principles, but the shapes of antennas vary with the frequency used, to which the antennas are made to resonate for effective operation.

However, for there are various radio communication standards, which use different frequencies to one another, an antenna must have a plurality of resonant frequencies to be used for all standard. Further, recently portable radio communication devices have integrated functions including GPS, data communication, authentication, e-payment, etc. as well as voice communication, expanding application thereof, and these functions use different frequency bands, increasing the need for multi-band antenna.

For example, there exists the need for operating one radio communication device at 800 MHz band for DCN (Digital Cellular Network), GSM850 and GSM900, 1800 MHz band for K-PCS, DCS-1800 and USPCS, 2 GHz for UMTS, 2.4 GHz for WLL, WLAN and Bluetooth, and 2.6 GHz for satellite DMB, growing necessity of developing multi-band antennas.

In the meantime, radio communication device, which has become a necessity in modern life, tends to be smaller and lighter and so does antenna. Therefore, in these days antenna developers are in a technical and strategic position where they have to develop smaller but high-performance antennas.

Especially, recently the design of mobile radio communication device become various and built-in antennas that allow for high degree of freedom without affecting appearance of the device are employed much more than the past. In accordance, the main task in antenna research and development is to implement multi-band antenna having a plurality of resonant frequencies in limited and narrow interior space of communication devices effectively.

For convenience, conventional multi-band antennas are shown in FIGS. 1, 3 and 5.

FIG. 1 shows a conventional triple-band antenna. The antenna comprises ground plane 60, feed part 40, ground part 50, and the first to third radiating elements 10, 20 and 30. The conventional antenna exhibits triple band resonance characteristic, as shown in FIG. 2. In other words, the antenna of FIG. 1 has three resonant frequencies including the first resonant frequency around 800 MHz, the second resonant frequency around 1.8 GHz, and the third resonant frequency around 2.4 GHz. These resonant frequencies are determined by electrical lengths of the first radiating element 10, the second radiating element 20 and the third radiating element 30, respectively.

As shown in FIG. 3, if the second radiating element 20 is removed from the triple-band antenna of FIG. 1, it exhibits a resonant characteristic totally different from what it showed before with the third resonant frequency moved toward 1.8 GHz band as shown in FIG. 4.

Similarly, if the third radiating element 30 is removed from the conventional triple-band antenna as shown in FIG. 5, the first resonant frequency moves toward high frequency region, thus the frequency characteristics around the second resonant frequency is also changed drastically.

Generally, because for multi-band antennas, radiating elements should be placed in narrow and limited space achieving multi-resonant characteristics, radiating elements with various lengths, widths, and shapes are employed. In this case, as above, when adjusting one of resonant frequencies, another resonant frequency is changed due to the undesired inter-element effect.

Therefore, to set desired multi-band resonant frequencies, one resonant frequency is adjusted first, another frequency is adjusted, and finally, the resonant frequency adjusted previously has to be re-adjusted finely. Accordingly, as the number of radiating elements, thus number of frequency bands increases, the number of steps needed to adjust resonant frequencies increases exponentially and too much time and effort are required to develop an antenna.

DISCLOSURE OF INVENTION

Technical Problem

It is an object of the invention to provide a multi-band antenna and method for adjusting resonant frequencies for adjusting resonant frequencies of the antenna accurately by adjusting only a part of radiating elements of the antenna.

It is also an objective of the invention to provide a multi-band antenna and method for adjusting resonant frequencies for adjusting resonant frequencies independently to one another without redundant adjustment.

Technical Solution

According to one aspect of the invention, present invention provides a multi-band built-in antenna, comprising: a main radiating element connected to a ground part and a feed part, the main radiating element being parallel to a ground plane; a secondary radiating element arranged parallel to the main radiating element; and a connecting element connecting the main radiating element and the secondary radiating element, which defines a slit between the main radiating element and the secondary radiating element, wherein the secondary radiating element has a length such that the antenna resonates to a first resonant frequency, and the connecting element has a width such that the antenna resonate to a second resonant frequency.

It is preferred that the first resonant frequency is in the frequency band used for DCN (Digital Cellular Network), and the second resonant frequency is in the frequency band used for DMB (Digital Multimedia Broadcasting).

According to another aspect, present invention provides the multi-band built-in antenna according to claim 1, further comprising an additive radiating element connected to and arranged coplanar with the main radiating element, wherein the additive radiating element has an electrical length such that the antenna resonates to a third resonant frequency.

It is preferred that the additive radiating element is of a meander shape, and an end portion of the meander shape has a width such that the antenna resonates to the third resonant frequency.

Further, preferably, the additive radiating element is arranged inside the main radiating element.

In addition, it is preferred that, the first resonant frequency is in the frequency band used for DCN (Digital Cellular Network), the second resonant frequency is in the frequency band used for DMB (Digital Multimedia Broadcasting), and the third resonant frequency is in the frequency band used for K-PCS (Korea-Personal Communications Services).

The antenna may further comprise a dielectric body supporting the main radiating element, the secondary radiating element and the connecting element.

According to further aspect of the invention, present invention provides a method for adjusting resonant frequencies of a multi-band built-in antenna comprising a main radiating element connected to a ground part and a feed part, the main radiating element being parallel to a ground plane, a secondary radiating element arranged parallel to the main radiating element, and a connecting element connecting the main radiating element and the secondary radiating element, which defines a slit between the main radiating element and the secondary radiating element, comprising:

adjusting a first resonant frequency roughly by setting total length of the main radiating element, the secondary radiating element, and the connecting element to $\lambda_1/4$, wherein $\lambda_1$ is a wavelength corresponding to a first target resonant frequency;

adjusting a second resonant frequency roughly by setting a length of the slit to $\lambda_2/4$, wherein $\lambda_2$ is a wavelength corresponding to a second target resonant frequency;

adjusting the first resonant frequency finely by adjusting a length of the secondary radiating element; and adjusting the second resonant frequency finely by adjusting a width of the connecting element.

Here, the adjusting the first resonant frequency roughly and the adjusting the second resonant frequency roughly may be performed concurrently.

It is preferred that the first resonant frequency is in the frequency band used for DCN (Digital Cellular Network), and the second resonant frequency is in the frequency band used for DMB (Digital Multimedia Broadcasting).

According to another aspect, present invention provides, a method for adjusting resonant frequencies of a multi-band built-in antenna comprising a main radiating element connected to a ground part and a feed part, the main radiating element being parallel to a ground plane, a secondary radiating element arranged parallel to the main radiating element, a connecting element connecting the main radiating element and the secondary radiating element, which defines a slit between the main radiating element and the secondary radiating element, and an additive radiating element connected to and arranged coplanar with the main radiating element, comprising:

adjusting a first resonant frequency roughly by setting total length of the main radiating element, the secondary radiating element, and the connecting element to $\lambda_1/4$, wherein $\lambda_1$ is a wavelength corresponding to a first target resonant frequency;

adjusting a second resonant frequency roughly by setting a length of the slit to $\lambda_2/4$, wherein $\lambda_2$ is a wavelength corresponding to a second target resonant frequency;

adjusting a third resonant frequency by setting an electrical length of the additive radiating element to $\lambda_3/4$, wherein $\lambda_3$ is a wavelength corresponding to a third target resonant frequency;

adjusting the first resonant frequency finely by adjusting a length of the secondary radiating element; and adjusting the second resonant frequency finely by adjusting a width of the connecting element.

The adjusting the first resonant frequency roughly and the adjusting the second resonant frequency roughly may be performed concurrently.

Further, the additive radiating element may be of a meander shape, and the adjusting the third resonant frequency may comprise adjusting the third resonant frequency finely by adjusting a width of an end portion of the meander shape.

Preferably, the first resonant frequency is in the frequency band used for DCN (Digital Cellular Network), the second resonant frequency is in the frequency band used for DMB (Digital Multimedia Broadcasting), and the third resonant frequency is in the frequency band used for K-PCS (Korea-Personal Communications Services).

Advantageous Effects

According to the invention, it is possible to adjust resonant frequencies of an antenna by adjusting dimension of only a part of the antenna, and to adjust plurality of resonant frequencies each of which is adjusted independently avoiding repetitive adjustments.

BRIEF DESCRIPTION OF THE DRAWINGS

The features and nature of the present invention will become more apparent from the detailed description set forth below when taken in conjunction with the drawings in which like reference characters identify correspondingly throughout and wherein:

FIG. 1 shows a conventional triple-band built-in antenna;

FIG. 2 shows resonant characteristics of the conventional triple-band antenna;

FIG. 3 shows the built-in antenna in which the second radiating element is removed from the triple-band built-in antenna of FIG. 1;

FIG. 4 shows the resonant characteristics of the built-in antenna of FIG. 3;

FIG. 5 shows the built-in antenna in which the third radiating element is removed from the triple-band built-in antenna of FIG. 1;

FIG. 6 shows the resonant characteristics of the built-in antenna of FIG. 5;

FIG. 7 shows a dual-band built-in antenna according to an embodiment of the invention;

FIG. 8 shows the change in resonant characteristics of the built-in antenna of FIG. 7 according to the change of the width of the connecting element;

FIG. 9 shows a triple-band built-in antenna in which the additive radiating element is added to the antenna of FIG. 7;

FIG. 10 shows the change in resonant characteristics of the antenna due to adding the additive radiating element;

FIG. 11 shows the resonant characteristics of the triple-band built-in antenna of FIG. 10 according to the change of the width of the end portion of the additive radiating element;

FIG. 12 is a flowchart illustrating the method for adjusting resonant frequencies of a dual-band antenna according to an embodiment of the invention; and FIG. 13 is a flowchart illustrating the method for adjusting resonant frequencies of a triple-band antenna according to another embodiment of the invention.

BEST MODE FOR CARRYING OUT THE INVENTION

Below, referring to accompanying drawings, the preferred embodiment of the invention is described in detail. It is omitted the description of the well-know functions and components which could blur the essence of the invention.

FIG. 7 shows a dual-band built-in antenna according to an embodiment of the invention. The dual-band built-in antenna may comprise, as shown in FIG. 7, a main radiating element 100, connecting element 130 and secondary radiating element 120, the main radiating element 100 being connected to an feed part 140 and ground part 150.

The main radiating element 100, the connecting element 130 and the secondary radiating element 120 may constitute a radiator as a whole, determining the first resonant frequency. That is, when the wave length corresponding to the first target resonant frequency is $\lambda_1$, the total length (L1+L2+L3) of the main radiating element 100, connecting element 130, and the secondary radiating element 120 may be determined as $\lambda_1/4$, determining the first resonant frequency. Further, in determining the first resonant frequency, it is possible to adjust the first resonant frequency of the antenna finely by adjusting only the length L3 of the secondary radiating element 120, which is a part of the radiator.

The main radiating element 100 and the secondary radiating element 120 arranged parallel thereto may define a gap between them, determining the second resonant frequency. Specifically, the gap between the main radiating element 100 and the secondary radiating element 120 may function as a slit of radiator, having the antenna resonate at the second resonant frequency. Here, the length of the slit, which is the length (L3-W1) from the end of connecting element 130 to the end of the secondary radiating element 120, may be set to $\lambda_2/4$, wherein $\lambda_2$ is the wave length corresponding to the second target resonant frequency. Therefore, by adjusting the width W1 of the connecting element 130, the length of slit may be adjusted and eventually the second resonant frequency adjusted.

Upon adjusting the width W1 of the connecting element 130, the first resonant frequency determined by the length L1+L2+L3 does not alter. Therefore, according to the present embodiment, after setting the first resonant frequency, the second resonant frequency may be adjusted to the target frequency independently and two resonant frequencies can be adjusted simply and quickly without repetitive adjustments.

While only elements 100, 120, 130 of the antenna are shown in FIG. 7, it is possible to place a dielectric body, preferably box-shaped, in conjunction with the elements 100, 120, 130 to support them and improve the characteristics of the antenna.

As an implementation of the dual-band antenna according to the invention, there were presented the main radiating element 100, the connecting element 130 and the secondary radiating element 120 in the space of 30 mm width, 8 mm length, and 5 mm height (from the ground plane). The lengths (L1, L2, L3) of main radiating element 100, the connecting element 130, and the secondary radiating element 120 were set such that the first resonant frequency was in 800 MHz band used for DCN, and the length (L3-W1) of the slit between the main radiating element 100 and the secondary radiating element 120 was set such that the second resonant frequency was in 2.6 GHz band used for DMB. Then the second resonant frequency was adjusted finely by adjusting the width W1 of the connecting element 130, and the resultant resonant characteristics are depicted in FIG. 8. It was assured that the change in the width W1 alter only the second resonant frequency not changing the first resonant frequency as shown in FIG. 8.

FIG. 9 shows a triple-band built-in antenna according to another embodiment of the invention, where the lengths L1, L2, L3 are not indicated for clarity, which are the same as in FIG. 7. The triple-band built-in antenna according to the invention may further comprise an additive radiating element 110 added to the antenna of previous embodiment.

The main radiating element 100, the connecting element 130 and the secondary radiating element 120 may constitute a radiator as a whole, the total length (L1+L2+L3) of which may be set to $\lambda_1/4$, determining the first resonant frequency, wherein $\lambda_1$ is the wave length corresponding to the first target resonant frequency. In determining the first resonant frequency, it is possible to adjust the first resonant frequency accurately by adjusting only the length L3 of the secondary radiating element 120 finely, which is a part of the radiator.

The main radiating element 100 and the secondary radiating element 120 arranged parallel thereto may define a slit with length of $\lambda_2/4$, determining the second resonant frequency, wherein $\lambda_2$ is the wave length corresponding to the second target resonant frequency. Therefore, by adjusting the width W1 of the connecting element 130, it is possible to adjust the length of the slit L3-W1, thus the second resonant frequency.

The additive radiating element 110 arranged coplanar with the main radiating element 100 may determine the third resonant frequency. That is, the additive radiating element 110 may have the electrical length of $\lambda_3/4$ and resonate at the third resonant frequency, wherein $\lambda_3$ is the wave length corresponding to the third resonant frequency. The additive radiating element may arranged inside the main radiating element 100 in meander shape, minimizing the space antenna occupies. While the first and second resonant frequency may be altered slightly upon addition of additive radiating element 110, the change can be compensated by fine adjustments of the length L3 of the secondary radiating element and the width W1 of the connecting element, which may be performed independently to each other.

Meanwhile, the third resonant frequency may be adjusted accurately by adjusting the width W2 of the end portion of the additive radiating element 110 of meander shape. The third resonant frequency may be adjusted because the change in width W2 alters the electrical length of the additive radiating element 110. For the change in the width W2, however, does not affect the lengths L1, L2, L3 and the width W1, the third resonant frequency may be adjusted independently to the first and the second resonant frequency without altering them.

FIG. 10 depicts the change in radiating characteristics of the implemented antenna due to the addition of the additive radiating element 110 to the implementation of previous embodiment. The length of the additive radiating element 110 was set such that it resonated in the frequency band used for K-PCS. As shown in FIG. 10, the third resonant frequency was introduced in 1.8 GHz band used for PCS and the first and second frequencies altered due to addition of the additive radiating element 110. The change in the frequencies, however, were small as about 40 MHz, it was assured that they could be adjusted by adjusting the length L3 of the secondary radiating element 120 and the width W1 of the connecting element 130.

FIG. 11 shows resonant characteristics of the implemented antenna according to the change of width W2. As shown in FIG. 11, it was assured that the change in the width W2 results in the change in the third resonant frequency in 1.8 GHz band, but the first and second resonant frequencies are barely affected. Therefore, it was possible to adjust the third resonant frequency without affecting the first and the second resonant frequencies after setting them, and to implement a triple-band antenna without repetitive fine adjustment of resonant frequencies.

While only elements 100, 110, 120, 130 of the antenna are shown in FIG. 9, it is possible to place a dielectric body, preferably box-shaped, in conjunction with the elements 100, 110, 120, 130, to support them and improve the characteristics of the antenna.

The method for adjusting resonant frequencies of multi-band built-in antenna according to the invention is described below.

According to an embodiment of the invention, provided is the method for adjusting the resonant frequencies of a dual-band antenna. In this embodiment, referring to FIG. 7 and 12, initially the total length L1+L2+L3 of the main radiating element 100, the connecting element 130 and the secondary radiating element 120 is set to adjust the first resonant frequency roughly in step S100. In this step S100, the total length L1+L2+L3 of the main radiating element 100, the connecting element 130 and the secondary radiating element 120 may be set to $\lambda_1/4$, wherein $\lambda_1$ is the wave length corresponding to the first target resonant frequency.

Then, the second resonant frequency is adjusted roughly in step S110, by setting the length L3-W1 of the slit defined by the main radiating element 100 and the secondary radiating element 120 to $\lambda_2/4$, wherein $\lambda_2$ is the wave length corresponding to the second target resonant frequency.

Although the steps S100 and S110 are described as separate steps, it is possible to perform them concurrently upon preparation of the elements 100, 120, and 130. Therefore, the rough adjustment of the first and second frequencies may be achieved at the same time in producing the radiator including elements 100, 120, and 130.

Because antenna of the invention is not a simple monopole antenna, but has a gap between the main radiating element 100 and the secondary radiating element 120, resonant may not occur at the first target resonant frequency when the total length L1+L2+L3 is exactly $\lambda_1/4$. Thus, in step S120, the length L3 of secondary radiating element 120 may be adjusted, the first resonant frequency be adjusted finely and the exact resonant frequency which is the same as the first target resonant frequency be achieved.

Then, the length L3-W1 of the slit is adjusted finely by adjusting the width W1 of the connecting element 130, and the second resonant frequency is adjusted accurately to the second target resonant frequency without change in the first resonant frequency in step S130. The two resonant frequencies can be adjusted quickly and accurately, because the first resonant frequency is not altered by change in the width W1 of the connecting element 130.

According to the embodiment, resonant frequencies of the antenna can be adjusted by adjusting the dimension of parts of radiator such as the secondary radiating element 120 and the connecting element 130, not of the whole radiator. Further, because each dimensions only affects corresponding resonant frequencies, it is possible to adjust two resonant frequencies simply and accurately without repetitive adjustments.

According to another embodiment of the invention, there is provided a method for adjusting resonant frequencies of a triple-band built-in antenna.

Referring to FIGS. 9 and 13, initially the first resonant frequency is adjusted roughly by setting the total length (L1+L2+L3) of the main radiating element 100, the connecting element 130, and the secondary radiating element 120 to $\lambda_1/4$ in step S200, wherein $\lambda_1$ is the wave length corresponding to the first target resonant frequency. Further, in step S210, setting the length L3-W1 of the slit defined by the main radiating element 100 and the secondary radiating element 120 to $\lambda_2/4$, the second resonant frequency is adjusted roughly, wherein $\lambda_2$ is the wave length corresponding to the second target resonant frequency.

Then, the third resonant frequency is adjusted roughly by setting the length of additive radiating element 110 to $\lambda_3/4$ in the step S220, wherein $\lambda_3$ is the wave length corresponding to the third resonant frequency. As described above, in this step, the first and second resonant frequencies may be changed slightly due to the addition of the additive radiating element 110.

Although the steps S200 and S210 are described as separate steps, it is possible to perform them concurrently upon preparation of the elements 100, 120, and 130. Further, it is possible to perform the steps S200, S210 and S220 concurrently upon preparation of the elements 100, 110, 120, and 130. In this case, the rough adjustment of the first to third resonant frequencies may be achieved at the same time in producing the radiator including elements 100, 110, 120, and 130.

As mentioned above, due to the gap between the main radiating element 100 and the secondary radiating element 120, and the addition of the additive radiating element 120, the first resonant frequency may be different from the first target resonant frequency. Thus, in step S230, the first resonant frequency may be adjusted finely. The first resonant frequency may be adjusted to the first target resonant frequency accurately by adjusting the length L3 of the secondary radiating element 120.

Next, the second resonant frequency is adjusted finely in step S240. The second resonant frequency may be adjusted to the second target resonant frequency accurately by adjusting the width W1 of the connecting element, thus the length of the slit L3-W1 between the main radiating element 100 and the secondary radiating element 120. Varying the width W1 does not affect the first resonant frequency and the second resonant frequency can be adjusted simply and independently.

Finally, by adjusting the length of the additive radiating element 110, the third resonant frequency is adjusted to the third target resonant frequency in step S250. It is preferred that the additive radiating element 110 has a shape of meander for antenna to have the third resonant frequency in spite of the limited space inside a mobile phone, and the fine adjustment of the third resonant frequency may be performed through adjustment of the width W2 of a end portion of the additive radiating element 110. As mentioned above, varying the width W2 does not affect the first and second resonant frequency, and the third resonant frequency can be adjusted independently.

According to the present embodiment, resonant frequencies of an antenna can be adjusted by adjusting dimensions of only parts of the radiator such as the secondary radiating element 120, the connecting element 130 and the additive radiating element 110. In addition, because each of the dimensions affects only the corresponding resonant frequency, three resonant frequencies can be adjusted simply and accurately without repetitive adjustments.

The multi-band built-in antenna according to the invention can be applied the space of 30~40 mm width and 60~100 mm length, and it is possible to apply it to the mobile phones of folder-type and slide-type as well as of bar-type.

Although the invention has been described with reference to specific embodiments, various modifications to these embodiments will be readily apparent to those skilled in the art without departing from the spirit or scope of the invention. For example, a quad- or more-band antenna can be produced by adding another radiating element to the embodiment of the invention. Further, the method for adjusting resonant frequency of the invention may be applied to quad- or more-band antennas as well as dual- or triple-band one. Also, the order of the steps described in above embodiments are not absolute, and various modifications to the order will be readily apparent to those skilled in the art without departing from the spirit or scope of the invention.

Thus, the present invention is not intended to be limited to the embodiments shown herein but is to be accorded the widest scope defined by appended claims and the equivalents thereto.

The invention claimed is:

1. A multi-band built-in antenna, comprising:

a main radiating element connected to a ground part and a feed part, the main radiating element being parallel to a ground plane;

a secondary radiating element arranged parallel to the main radiating element; and a connecting element connecting the main radiating element and the secondary radiating element, which defines a slit between the main radiating element and the secondary radiating element, wherein the secondary radiating element has a length such that the antenna resonates to a first resonant frequency, and the connecting element has a width such that the antenna resonate to a second resonant frequency.

2. The multi-band built-in antenna according to claim 1, wherein the first resonant frequency is in the frequency band used for DCN (Digital Cellular Network), and the second resonant frequency is in the frequency band used for DMB (Digital Multimedia Broadcasting).

3. The multi-band built-in antenna according to claim 1, further comprising an additive radiating element connected to and arranged coplanar with the main radiating element, wherein the additive radiating element has an electrical length such that the antenna resonates to a third resonant frequency.

4. The multi-band built-in antenna according to claim 3, wherein the additive radiating element is of a meander shape, and an end portion of the meander shape has a width such that the antenna resonates to the third resonant frequency.

5. The multi-band built-in antenna according to claim 3 or claim 4, wherein the additive radiating element is arranged inside the main radiating element.

6. The multi-band built-in antenna according to claim 3 or claim 4, wherein the first resonant frequency is in the frequency band used for DCN (Digital Cellular Network), the second resonant frequency is in the frequency band used for DMB (Digital Multimedia Broadcasting), and the third resonant frequency is in the frequency band used for K-PCS (Korea-Personal Communications Services).

7. The multi-band built-in antenna according to any one of claims 1 to 4, further comprising a dielectric body supporting the main radiating element, the secondary radiating element and the connecting element.

8. The multi-band built-in antenna according to claim 1, wherein the first resonant frequency is adjusted by setting the total length of the main radiating element, the secondary radiating element, and the connecting element to $\lambda_1/4$, wherein $\lambda_1$ is a wavelength corresponding to a first target resonant frequency.

9. The multi-band built-in antenna according to claim 1, wherein the second resonant frequency is adjusted by setting a length of the slit to $\lambda_2/4$, wherein $\lambda_2$ is a wavelength corresponding to a second target resonant frequency.

10. The multi-band built-in antenna according to claim 1, wherein the first resonant frequency is finely adjusted by adjusting a length L3 of the secondary radiating element and the second resonant frequency is finely adjusted by adjusting a width W1 of the connecting element.

11. The multi-band built-in antenna according to claim 1, wherein the third resonant frequency is adjusted by setting an electrical length of the additive radiating element to $\lambda_3/4$, wherein $\lambda_3$ is a wavelength corresponding to a third target resonant frequency.

* * * * *